US005828177A

United States Patent [19]

Toda et al.

[11] Patent Number: 5,828,177

[45] Date of Patent: Oct. 27, 1998

[54] LIGHT CIRCUIT FOR DISCHARGE LAMP

[75] Inventors: Atsushi Toda; Goichi Oda; Masayasu Yamashita, all of Shimizu, Japan

[73] Assignee: Koito Manufacturing Co., Ltd., Tokyo, Japan

[21] Appl. No.: 795,667

[22] Filed: Feb. 6, 1997

[30] Foreign Application Priority Data

Feb. 14, 1996 [JP] Japan ..... 8-049671

[51] Int. Cl.[6] ..... H05B 37/00

[52] U.S. Cl. ..... 315/127; 315/308; 315/82; 307/10.8; 361/79

[58] Field of Search ..... 315/119, 82, 83, 315/127, 225, 224, 219, 291, 307, 308, DIG. 7; 307/10.8; 361/78, 79, 90, 94

[56] References Cited

U.S. PATENT DOCUMENTS

| | | | |
|---|---|---|---|
| 5,068,570 | 11/1991 | Oda et al. | 315/128 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/127 |
| 5,212,428 | 5/1993 | Sasaki et al. | 315/308 |
| 5,278,452 | 1/1994 | Matsumoto et al. | 307/10.8 |
| 5,295,036 | 3/1994 | Yagi et al. | 361/79 |
| 5,422,548 | 6/1995 | Yamashita et al. | 315/308 |
| 5,449,973 | 9/1995 | Yamashita et al. | 315/82 |
| 5,485,059 | 1/1996 | Yamashita et al. | 315/307 |
| 5,486,740 | 1/1996 | Yamashita et al. | 315/308 |
| 5,514,935 | 5/1996 | Oda et al. | 315/82 |
| 5,629,588 | 5/1997 | Oda et al. | 315/308 |

FOREIGN PATENT DOCUMENTS

| | | |
|---|---|---|
| 4017415 | 2/1991 | Germany . |
| 4129557 | 9/1991 | Germany . |
| 4134537 | 4/1992 | Germany . |

*Primary Examiner*—Robert J. Pascal
*Assistant Examiner*—Haissa Philogene
*Attorney, Agent, or Firm*—Fitzpatrick, Cella, Harper & Scinto

[57] ABSTRACT

A lighting circuit for a discharge lamp comprises detection means for detecting a voltage and/or a current to be applied to a discharge lamp or a voltage and/or a current equivalent thereto, input voltage/current detection means for detecting an input voltage and/or an input current to the lighting circuit, and abnormality detection means for stopping power supply to the discharge lamp when detecting an abnormality in the discharge lamp or a circuit abnormality based on those detection signals. In the abnormality detection means, a plurality of reference values for comparison or a plurality of reference ranges are set for the detection signals, and determination times are set in association with the reference values or reference ranges. The abnormality detection means compares the levels of the detection signals with each of the reference values or the reference ranges and determines that an abnormality in the discharge lamp or a circuit abnormality has occurred when a certain comparison result continues for an associated determination time or longer.

20 Claims, 8 Drawing Sheets

1
2
Power Supply
9
3
Lighting Control Means
7
Voltage/ Current Detection Means
4
Ignition Means
7'
Voltage/ Current Detection Means
6
Input Voltage/ Current Detection Means
8
Abnormality Detection Means
5

LIGHT CIRCUIT FOR DISCHARGE LAMP

BACKGROUND OF THE INVENTION

1. Field of the Invention

The present invention relates to a novel discharge lamp lighting circuit, which stops supplying power to a discharge lamp when it is determined that an abnormality occurs in the discharge lamp or circuitry or the like.

2. Description of the Related Art

Recently, a compact discharge lamp (e.g., a metal halide lamp) is receiving greater attention as a light source which takes the place of an incandescent lamp. It is known that a lighting circuit for such a discharge lamp, as adapted to a light source for a vehicular lamp, includes a DC power supply, a switching power supply circuit, a DC-AC converter, and an igniter circuit.

Because a high voltage is supplied to ignite a discharge lamp, it is necessary to promptly cut off power supply to the discharge lamp when an abnormality occurs in the discharge lamp or the lighting circuit. One known circuit which accomplishes such power cutoff is provided with abnormality detection means and means for inhibiting power supply to a discharge lamp, so that when an abnormality in the discharge lamp or an abnormal circuit status is detected based on a detected voltage and/or detected current both associated with the discharge lamp, the power cutoff means stops power supply to the discharge lamp.

This circuit however may erroneously detect an abnormality in the transitional state of a discharge lamp until the discharge lamp reaches the steady lighting state.

In other words, since the detected voltage and detected current associated with a discharge lamp significantly vary in the transitional state of the discharge lamp as in the initial lighting stage, erroneous abnormality detection probably occurs if those values are simply compared with their associated, predetermined reference values.

One solution to this shortcoming is to set a predetermined determination time for the detection of an abnormality state and to determine the occurrence of an abnormality when a certain result of comparison of the detected voltage and/or the detected current, both associated with the discharge lamp, with its associated reference value continues for the determination time or longer. If the determination time with respect to the reference value for comparison is a fixed value, it is always determined that an abnormality has occurred in the discharge lamp or the lighting circuit, regardless of probable causes for such abnormalities, when a certain result of comparison of the detected voltage and/or the detected current, both associated with the discharge lamp, with its associated reference value continues for the determination time or longer It is therefore difficult to execute detailed abnormality detection.

For instance, the determination time should be set to the shortest one of determination times which are associated with probable causes for abnormalities. In this case, because of the determination time set to the shortest one, there is a chance of erroneously determining that an abnormality has occurred due to a reason different from the one associated with the shortest determination time, though no abnormality has actually occurred.

SUMMARY OF THE INVENTION

Accordingly, it is an objective of the present invention to provide a discharge lamp lighting circuit which can accurately detect an abnormality in a discharge lamp, a circuit abnormality and an abnormality associated with an input voltage to the lighting circuit.

To achieve this object, a lighting circuit for a discharge lamp according to this invention comprises detection means for detecting a voltage and/or a current to be applied to a discharge lamp or a voltage and/or a current equivalent thereto; and abnormality detection means for stopping power supply to the discharge lamp when detecting an abnormality in the discharge lamp or a circuit abnormality based on a detection signal from the detection means, whereby the abnormality detection means has a plurality of reference values for comparison or a plurality of reference ranges to be set for the detection signal from the detection means, and determination times to be respectively set in association with the plurality of reference values or reference ranges, compares a level of the detection signal with each of the reference values or the reference ranges and determines that an abnormality in the discharge lamp or a circuit abnormality has occurred when a certain comparison result continues for an associated determination time or longer.

According to this invention, as a plurality of reference values for comparison or a plurality of reference ranges are set for the detection signal from the detection means, and determination times are respectively set in association with those reference values or reference ranges, so that comparison and determination can be performed specifically in accordance with the cause for each abnormality.

DETAILED DESCRIPTION OF THE PREFERRED EMBODIMENT

The present invention will be described below with reference to FIGS. 1 through 9.

Figure 1:
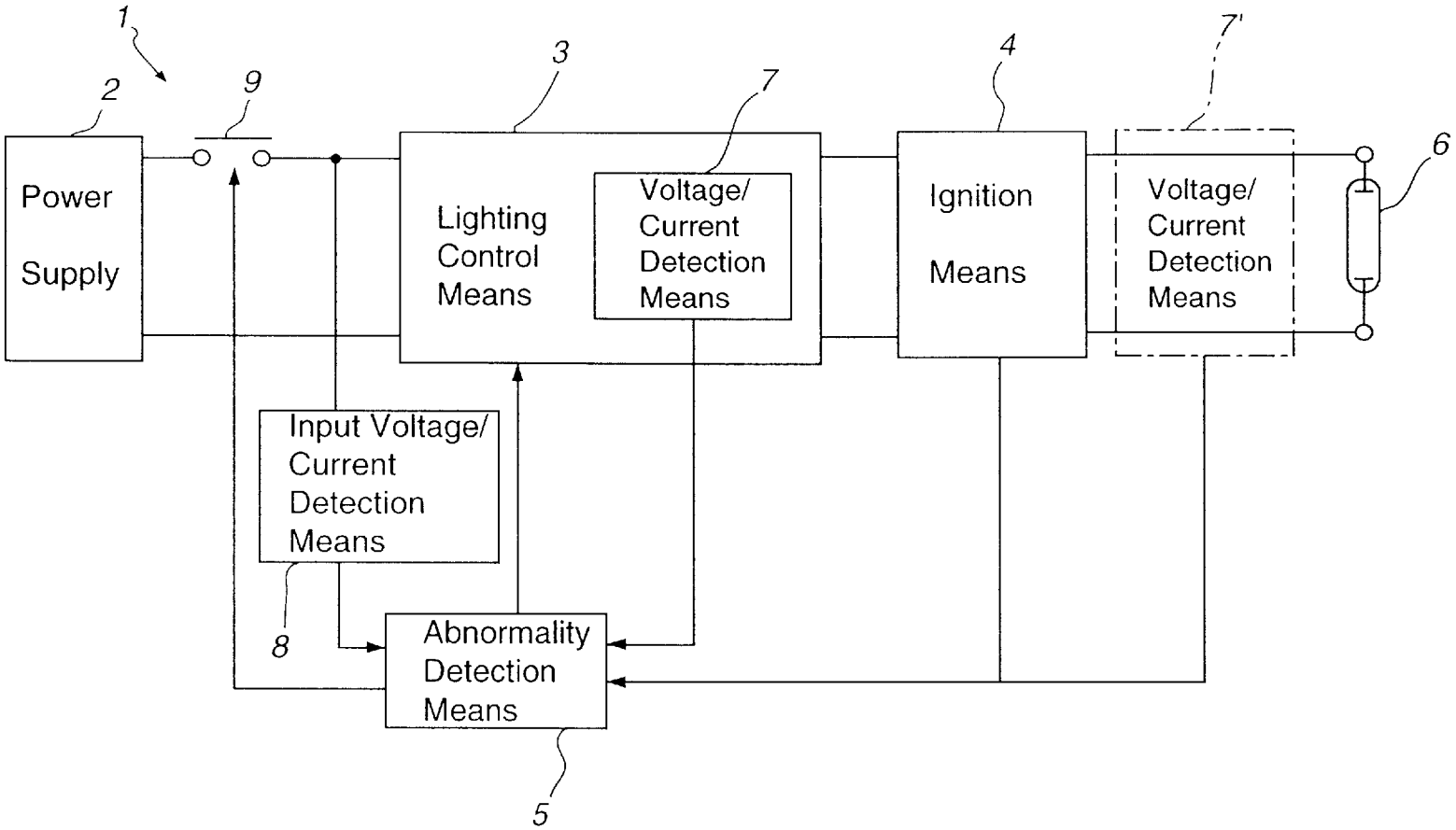
FIG. 1 is a circuit block diagram for explaining the structure of a lighting circuit for a discharge lamp according to this invention.

FIG. 1 illustrates the structure of a discharge lamp lighting circuit 1 according to this invention, which comprises a power supply 2, lighting control means 3, ignition means 4 and abnormality detection means 5.

The lighting control means 3 is provided to mainly execute power control necessary for the ignition of a discharge lamp 6 based on the power supply 2. The output of the lighting control means 3 is sent via the ignition means 4 to the discharge lamp 6.

The ignition means 4 serves to generate a trigger pulse for the discharge lamp 6 in the initial lighting stage to ignite the discharge lamp 6.

The abnormality detection means 5 serves to detect an abnormality in the circuit status of the discharge lamp 6 or an abnormality in the input voltage and/or input current to the lighting circuit 1 and inhibits power supply to the discharge lamp 6 upon detection of such an abnormality Information based on which abnormality detection is performed includes:

(1) Detection signals associated with the voltage and current applied to the discharge lamp or a control voltage and control current equivalent to those detection signals.

(2) Detection signals associated with the input voltage and input current to the lighting circuit.

First, the detection signals (1) can be acquired by voltage/current detection means 7 which is provided in the lighting control means 3 to obtain detection signals equivalent to the lamp voltage and lamp current of the discharge lamp 6, or by voltage/current detection means 7' which is provided in the ignition means 4 or at the subsequent stage thereof to detect the lamp voltage and lamp current of the discharge lamp 6 more directly.

The detection signals (2) can be acquired by input voltage/current detection means 8 which is provided to detect the input voltage and/or the input current to be supplied to the lighting circuit 1 from the power supply 2.

The abnormality detection means 5 serves to stop supplying power to the discharge lamp 6 when detecting the occurrence of an abnormality based on those information.

Power supply to the discharge lamp 6 may be inhibited by the following schemes:

(I) To cut off power supply to the lighting control means 3 from the power supply 2.

(II) To stop the operation of the lighting control means 3.

With regard to the scheme (I), switch means 9 may be provided between the power supply 2 and the lighting control means 3 as shown in, for example, FIG. 1, so that upon detection of an abnormality, the switch means 9 is opened to cut off power supply to the lighting control means 3.

According to the scheme (II), the operation of the lighting control means 3 is stopped in response to an abnormality detection signal which is sent to the lighting control means 3 from the abnormality detection means 5. This scheme is accomplished by, for example, directly stopping the operation of the lighting control means 3, which is associated with power control for the discharge lamp 6, conversion of the voltage to be applied to the discharge lamp 6 or the like, or by stopping the operation of an auxiliary power supply circuit for supplying a voltage needed for the components of the lighting control means 3.

The power cutoff technique in this invention is not limited to those mentioned above but any technique can be used as long as power supply to the discharge lamp 6 is stopped when an abnormality is detected. Further, once the occurrence of an abnormality is detected, the cutoff of power supply to the discharge lamp 6 may be maintained until the lighting circuit 1 is powered on again. Alternatively, upon occurrence of an abnormality, power supply to the discharge lamp 6 may be temporarily stopped but is resumed when the status of the discharge lamp 6 or the circuit status, or the input voltage or the input current is restored to the proper status.

Of the detections associated with the abnormality detection means 5, the detection (1) will be discussed first. In this case, the abnormality detection means 5 acquires the detected voltage and/or detected current associated with the discharge lamp 6 or signals equivalent thereto by the aforementioned voltage/current detection means 7 (or 7'), compares the levels of those signals with predetermined reference values to check which is greater or smaller (equilibrium state included in some case), and monitors the occurrence of an abnormality by determining if a certain comparison result continues for a predetermined determination time or longer. The "determination time" is the dominant parameter to determine how long an abnormality state should continue before power supply to the discharge lamp 6 is cut off, and is set for each of the reference values for the level comparison.

Figure 2:
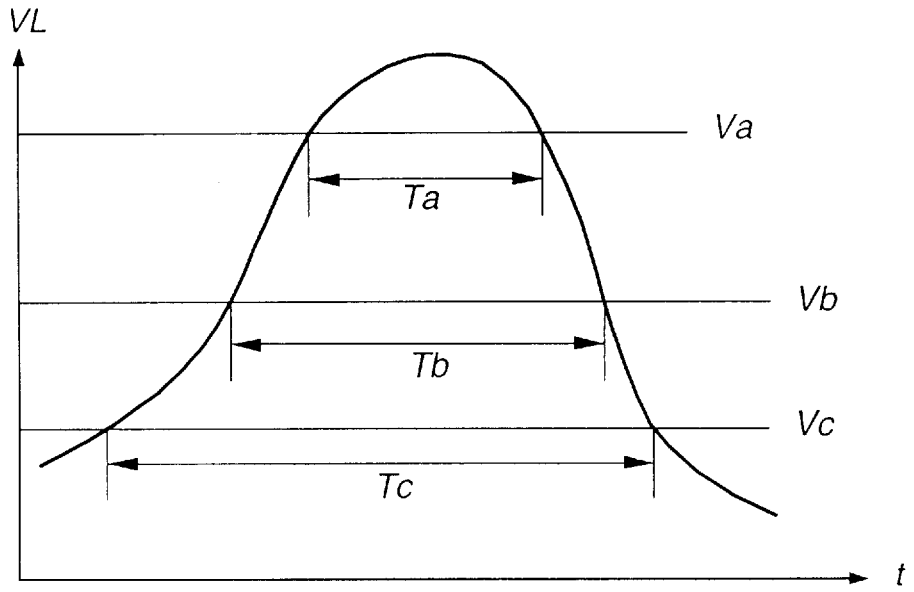
FIG. 2 is a diagram for explaining how to set reference values for comparison with respect to a detected voltage associated with a discharge lamp.
Figure 3:
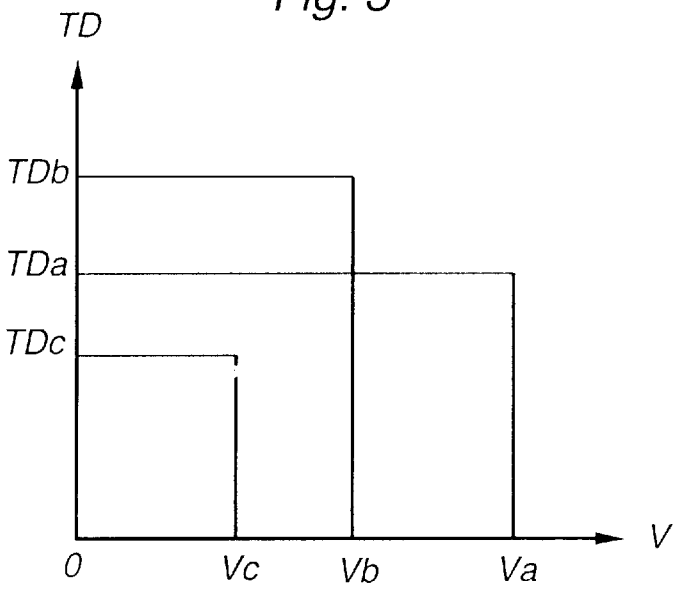
FIG. 3 is a diagram for explaining how to set determination times for the reference values.

FIGS. 2 and 3 are diagrams used for explaining how to set reference values for comparison and determination times associated with the reference values.

FIG. 2 exemplifies a time-dependent change in a detected voltage ("VL") associated with the discharge lamp 6, taken on the vertical scale, with respect to time t taken on the horizontal scale.

In this diagram, Va, Vb and Vc (Va>Vb>Vc) indicate reference values for comparison which are set with respect to the detected voltage VL, and Ta, Tb and Tc respectively indicate a time in which VL>Va, a time in which VL>Vb, and a time in which VL>Vc.

FIG. 3 exemplifies the relationship between the reference values for comparison and the determination times with the voltage ("V") taken on the horizontal scale and the determination time ("TD") taken on the vertical scale. TDa, TDb and TDc respectively denote the determination times for the reference values Va, Vb and Vc, and are set to be TDc<TDa<TDb in this example.

According to this invention, as apparent from the above, different determination times are set for different reference values for comparison, and times Ta, Tb and Tc are compared with the associated determination times TDa, TDb and TDc respectively in the example in FIG. 2 to detect an abnormality. (For example, it is determined that an abnormality has occurred when Tc>TDc.)

The relationship between the reference values for comparison and the determination times can be considered in two areas defined above and below an allowable range or a rated range (whose upper limit and lower limit are respectively denoted by "Va0" and "Vb0") of the detected voltage in the steady lighting mode of the discharge lamp 6.

Figure 4:
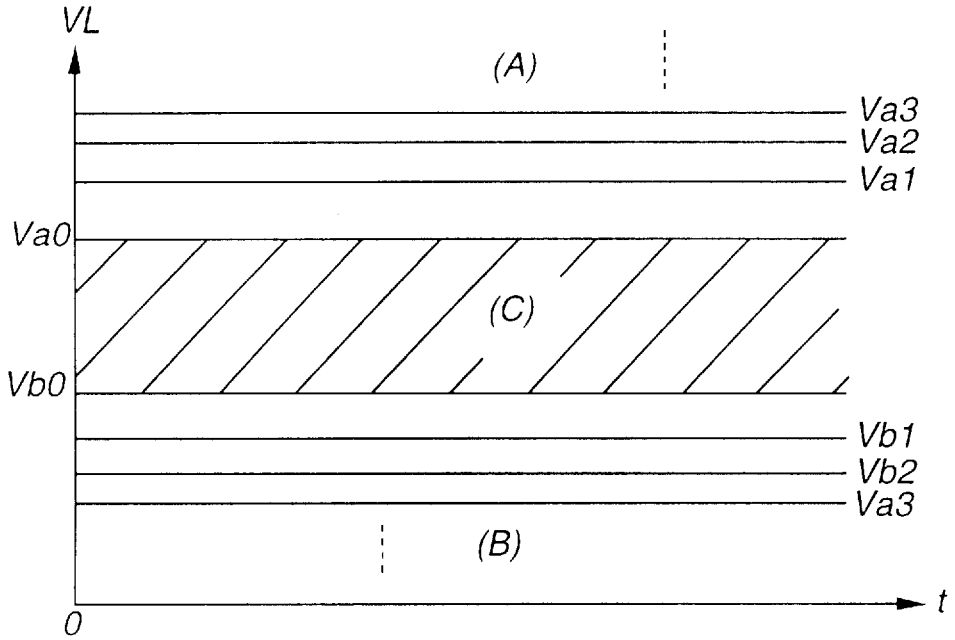
FIG. 4 is a diagram for explaining how to set reference values for comparison which lie above and below a predetermined range with respect to a detected voltage associated with a discharge lamp.

FIG. 4 shows the time t on the horizontal scale and the detected voltage VL associated with the discharge lamp 6 on the vertical scale, and illustrates reference values for comparison set in an area C (hatched in the diagram) indicating the voltage range in the steady lighting state of the discharge lamp 6 or the rated voltage range of the discharge lamp 6, and areas A and B respectively tying above and below the area C.

1With regard to the area A lying above the area C, reference values Vai (i=1, 2, . . . ) are set, the discriminator "i" is selected in such a way that as i increases, the level of Vai increases.

With regard to the area B lying below the area C, reference values Vbi (i =1, 2, . . . ) are set; the discriminator "i" is selected in such a way that as i increases, the level of Vbi decreases.

It is apparent that the discharge lamp is properly lit within the area C, so that reference values for comparison need not be set.

Figure 5:
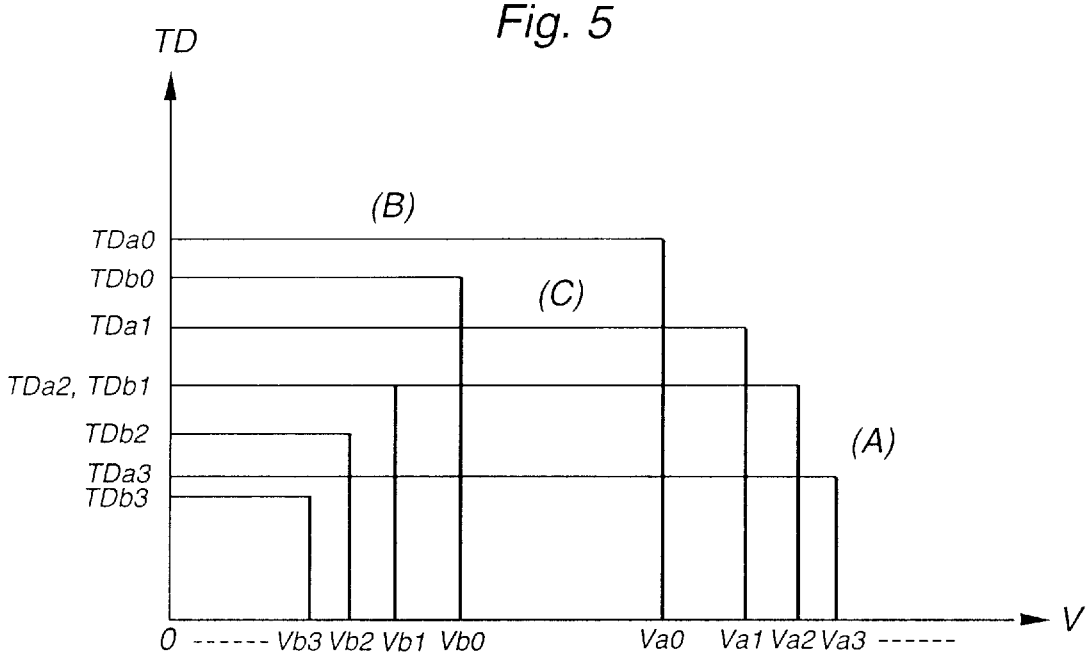
FIG. 5 is a diagram for explaining how to set determination times for the reference values shown in FIG. 4.

FIG. 5 shows the voltage V on the horizontal scale and the determination time TD on the vertical scale, which is to be set for each of the reference values Vai and Vbi (i=0, 1, 2, . . . ).

Figure 6:
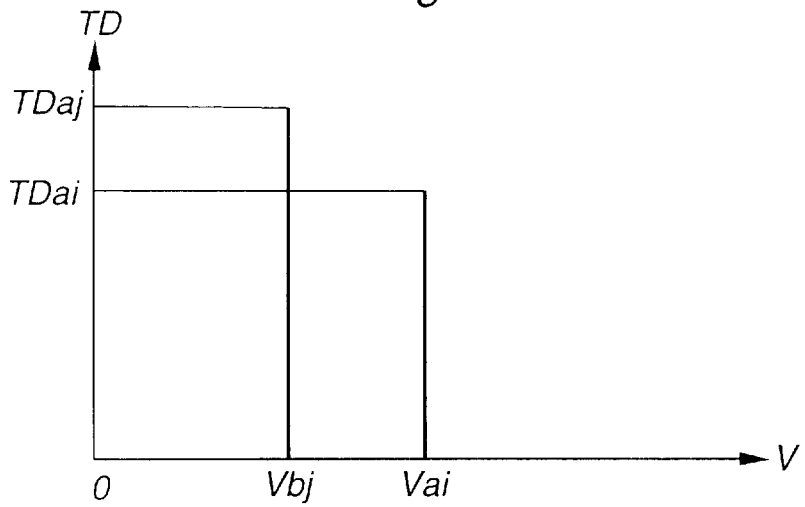
FIG. 6 is a diagram for explaining the level relation among the determination times with respect to the reference values.

As illustrated, the determination times corresponding to Vai and Vbi gradually decrease as the discriminator i increases. The values of Vai and Vbi should not necessarily always have a linear symmetrical relation with respect to the area C, but their relationship is set in such a way that the farther the reference values for comparison are positioned from the area C, the shorter the associated determination times become. When the determination times associated with Vai (i=0, 1, 2, . . . ) are given by "TDai" (i=0, 1, 2, . . . ) and the determination times associated with Vbj (j=0, 1, 2, . . . ) are given by "TDbj" (j=0, 1, 2, . . . ), generally TDai≠TDbj, but often TDai<TDbj as shown in FIG. 6 (the reason for which will be discussed later).

Figure 7:
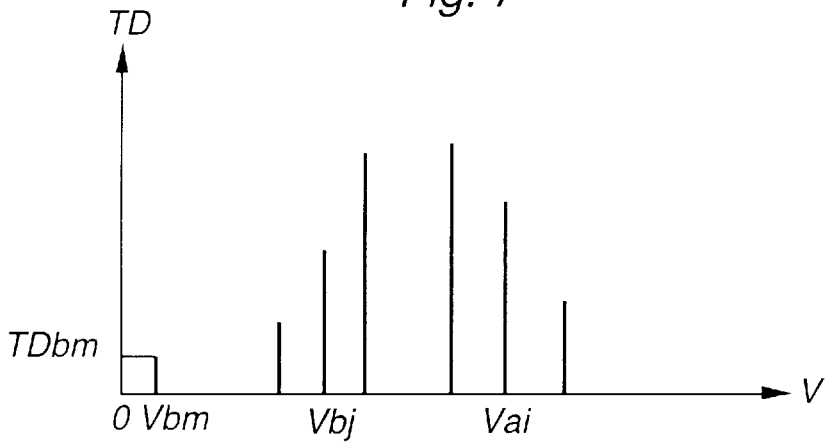
FIG. 7 is a diagram for explaining the level of the determination time which is set for the reference value that lies in the vicinity of zero.
Figure 8:
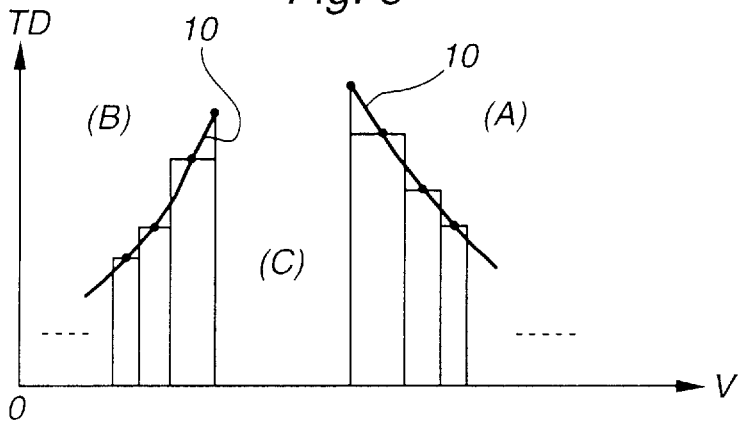
FIG. 8 is a diagram exemplifying how the determination times for the reference values are defined by a bar graph or a curve.

Given that "Vbm" denotes a reference value for comparison lying close to V=0 and "TDbm" denotes its associated determination time, as shown in FIG. 7, TDbm is set to a sufficiently smaller value than the determination time which is associated with a reference value for comparison located higher than Vbm for the following reason. Since the detected voltage VL being close to zero generally means the occurrence of a critical abnormality concerning a discharge lamp except for a very special case such as the state immediately after the lighting of a discharge lamp, if such an abnormal state occurs even slightly, it is desirable to immediately stop power supply to the discharge lamp from the viewpoint of preventing an electric-shock originated accident.

The relations between the reference values for comparison and their associated determination times are separately defined in FIGS. 3 and 5. Those relations are not restrictive, but the determination times may be separately defined in association with reference ranges for comparison as indicated by a bar graph in FIG. 8, or may be so defined as to be expressed by a continuous function with respect to reference values for comparison as indicated by curves 10 in the same diagram (except in the area C).

Although the foregoing description has discussed examples in which a plurality of reference values for comparison or reference ranges and their associated determination times have a predetermined relationship with respect to the detected voltage associated with a discharge lamp, a plurality of reference values for comparison or reference ranges and their associated determination times may also be set to have a predetermined relationship with respect to the detected current associated with a discharge lamp.

The detection of an abnormality in the input voltage, which is associated with the paragraph (2) will now be discussed. In this case, in detecting if the input voltage from the power supply 2 becomes higher than necessary or abnormally drops, the abnormality detection means 5 compares the level of the input voltage, which is supplied to the lighting control means 3 from the power supply 2 by the input voltage/current detection means 8, with the level of a predetermined reference value associated with this input voltage (equilibrium state included in some case), and monitors the occurrence of an abnormality by determining if a certain comparison result continues for a predetermined determination time or longer As in the case of the detection (1), a plurality of reference values for comparison or reference ranges are set with respect to the input voltage and determination times are separately set in association with those reference values or reference ranges.

The determination times are set in such a manner that the farther the reference values or the reference ranges are set from a predetermined allowable range (the rated range or the rated range with a factor of safety taken into consideration) for the level of the detection signal from the input voltage/current detection means 8, the shorter the determination times are set. Alternatively, any determination time set for a reference value for comparison or a reference range which lies above the allowable range, differs from any determination time set for a reference value for comparison or a reference range lying below the allowable range. For instance, one should consider the case where the input voltage is taken on the horizontal scale in FIG. 5, the area C is equivalent to the rated range or the allowable range associated with the input voltage, and Vai and Vbi indicate reference values for comparison associated with the input voltage.

The lighting circuit may be designed to include either the abnormality detection means associated with the detection (1) or the one associated with the detection (2), or may be designed to include both abnormality detection means associated with the detections (1) and (2). In the latter case, we should consider two cases, one where the determination times are set independently for the detections (1) and (2), and the other where a certain condition is given to the level relation between the determination times.

Assume that abnormal states associated with the detection (1) include the lighting disabled state of a discharge lamp and the short-circuited state of the connector terminal to the discharge lamp, and that abnormal states associated with the detection (2) include the overvoltage state of the input voltage and the abnormal dropping of the input voltage. In this case, while determination times with respect to reference values for comparison or reference ranges can be independently set between an abnormality originated from the lighting disabled state associated with the detection (1) and an overvoltage abnormality associated with the detection (2), determination times with respect to reference values for comparison or reference ranges cannot be independently set between an abnormality originated from the lighting disabled state associated with the detection (1) and an abnormal voltage drop associated with the detection (2). This may result in an undesirable effect unless certain conditions are given to the determination times between those two cases.

Let us consider the case where in an abnormality under the lighting disabled state associated with the detection (1), power supply to a discharge lamp is stopped after detection of an abnormality and this power cutoff state is maintained thereafter, while in the abnormal drop of the input voltage associated with the detection (2), power supply to a discharge lamp is temporarily stopped but is restarted when the input voltage is restored to the proper range. If the determination time for the lighting disabled state associated with the detection (1) is set shorter than the one for the abnormal drop of the input voltage associated with the detection (2), the former determination time is given priority over the latter, so that relighting of the discharge lamp due to restarting of power supply in the latter case may not be carried out in some case. In other words, unless the determination time for the abnormal drop of the input voltage associated with the detection (2) is set shorter than the one for the lighting disabled state associated with the detection (1), even when the discharge lamp goes to the lighting disabled state due to a drop of the input voltage (except for the case of the permanently disabled state) and the input is later returned to the proper range, in which case the discharge lamp should be lit again, the process for relighting the discharge lamp is substantially neglected. To avoid such an undesirable result, it is preferable that the determination time for the abnormal drop of the input voltage associated with the detection (2) should be set shorter than the one for the lighting disabled state associated with the detection (1).

Figure 9:
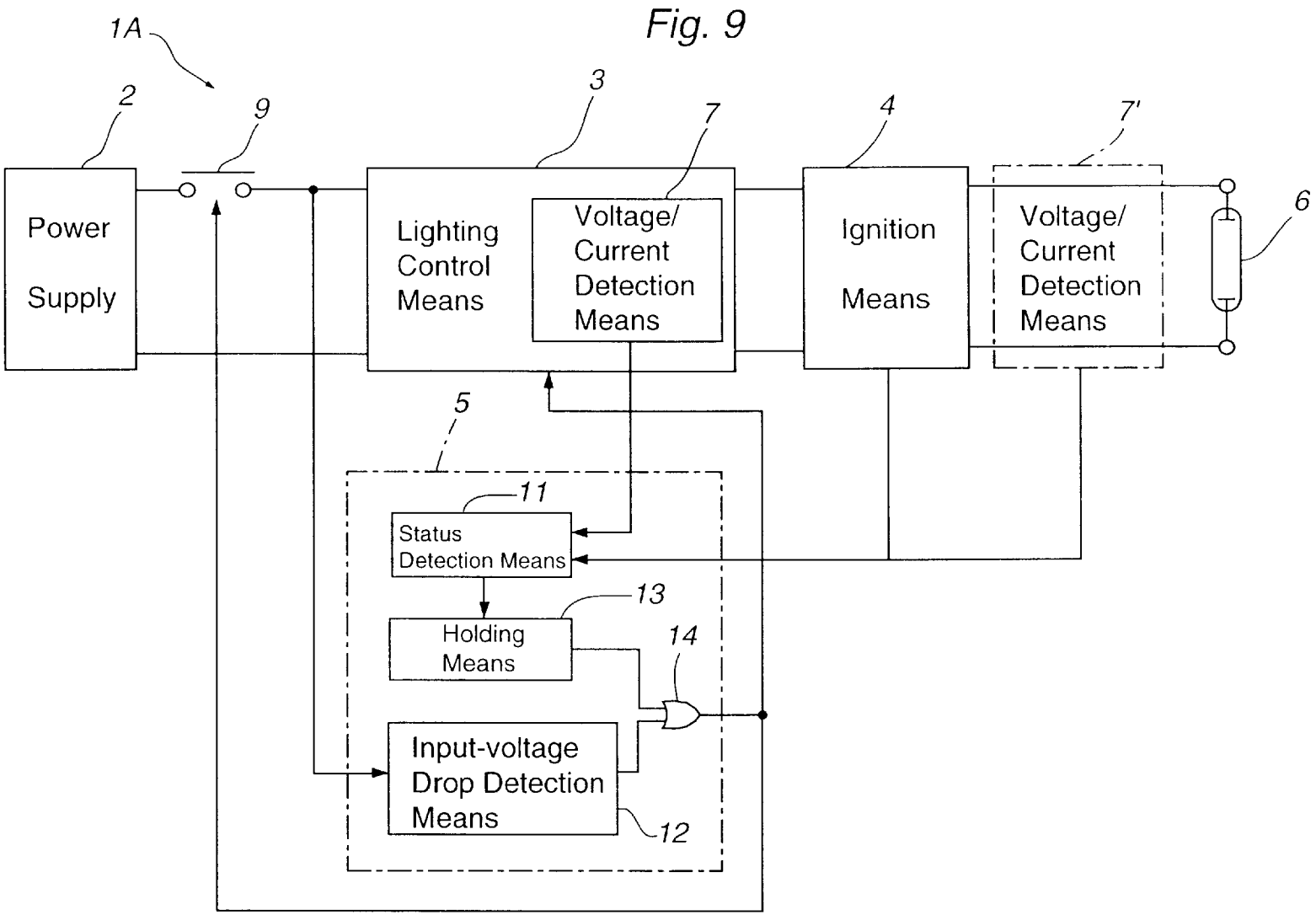
FIG. 9 is a block diagram illustrating the structure which is provided with status detection means for detecting the lighting disabled state or the like of a discharge lamp, and input-voltage drop detection means for detecting a drop of the input voltage.

FIG. 9 exemplifies a circuit structure 1A which is provided with status detection means 11 for detecting the open state of the connector terminal to be connected to the discharge lamp 6 and the lighting disabled state of the discharge lamp 6, and input-voltage drop detection means 12 for detecting if the input voltage to the lighting circuit is equal to or lower than a predetermined value.

The status detection means 11 compares the detected voltage and/or the detected current with a predetermined reference value for comparison based on information from the voltage/current detection means 7 (or 7'), determines the occurrence of an abnormality when a certain comparison result continues for a predetermined determination time ("TDo") or longer, and sends a determination signal to holding means 13 located at the subsequent stage to hold this signal As a result, power supply to the discharge lamp 6 is inhibited and this power cutoff state is maintained until the discharge lamp 6 is powered again next time.

The input-voltage drop detection means 12 determines that an abnormality has occurred in the input voltage from the power supply 2 when the input voltage is equal to or lower than a predetermined reference value for comparison and this state continues for a predetermined determination time ("TDs"; TDs<TDo) or longer, and temporarily stops power supply to the discharge lamp 6 without holding the determination signal.

Even in the case where the discharge lamp 6 temporarily goes to the lighting disabled state due to a drop in the input voltage, when the duration of the detection of an abnormality by the status detection means 11 is less than the determination time TDo and there is a chance of relighting the discharge lamp 6 after the restoring of the input voltage, even if the temporary dropping of the input voltage continues for the determination time TDs or longer, power supply to the discharge lamp 6 is restarted when the input voltage is later returned to the proper range.

In FIG. 9, the logical sum (indicated by an OR gate 14) of the output signals of the holding means 13 and the input-voltage drop detection means 12 is performed and this logical sum is sent to the lighting control means 3 and the switch means 9 to stop supplying power to the discharge lamp 6.

Although the foregoing description has discussed examples in which a plurality of reference values for comparison or reference ranges and their associated determination times have a predetermined relationship with respect to the input voltage to the lighting circuit, a plurality of reference values for comparison or reference ranges and their associated determination times may of course be set to have a predetermined relationship with respect to the input current to the lighting circuit.

FIGS. 10 through 14 illustrate one embodiment of this invention.

In a lighting circuit 15, a battery 16 equivalent to the aforementioned power supply 2 is connected between input terminals 17 and 17' and an ignition switch 19 is provided as a manual switch on one (18) of DC power lines 18 and 18'.

A DC power supply circuit 20 to which the battery voltage is input, boosts and/or reduces the battery voltage and sends its output to a DC-AC converter 21 located at the subsequent stage.

The DC-AC converter 21 converts the DC voltage output from the DC power supply circuit 20 to an AC voltage. For example, the DC-AC converter 21 may be designed to comprise a bridge circuit having plural pairs of semiconductor switch elements positioned on the power supply path to a discharge lamp 23 and a drive controller for driving this bridge circuit.

An igniter circuit 22, located at the subsequent stage of the DC-AC converter 21, generates a trigger pulse to the discharge lamp 23, superimposes this trigger pulse onto the output of the DC-AC converter 21, and applies the resultant signal to the discharge lamp 23, connected between AC output terminals 24 and 24'. The igniter circuit 22 is equivalent to the ignition means 4.

Provided between the DC power supply circuit 20 and the DC-AC converter 21 is a voltage/current detector 25 (equivalent to the aforementioned voltage/current detection means 7) for detecting the output voltage and output current of the DC power supply circuit 20. The voltage/current detector 25 sends a detection signal to a control circuit 26 and an abnormality detector/protection circuit 27.

The control circuit 26 generates a control signal according to the detection signal of the voltage/current detector 25, and sends the control signal to the DC power supply circuit 20 to control the output voltage thereof. In this manner, the control circuit 26 performs power control which matches with the ignition state of the discharge lamp 23 to shorten the ignition time and reignition time and stably light the discharge lamp 23 in the steady lighting mode. The control circuit 26, which may take a pulse width modulation type structure, can have another structure as well.

The abnormality detector/protection circuit 27 equivalent to the abnormality detection means 5 is provided to detect the circuit status of the discharge lamp 23 and an abnormality in the battery voltage. For example, the abnormality detector/protection circuit 27 detects the occurrence of abnormal states given below:

(a) The non-connection of the discharge lamp 23 to the AC output terminals 24 and 24' or the open state of the AC output terminals 24 and 24'.

(b) The lamp voltage exceeding the rated range as a sign of the degradation-oriented last stage of the service life of the discharge lamp 23.

(c) The state where the lamp voltage has not reached the rated range due to some leakage of what is sealed inside the discharge lamp 23.

(d) The state where the lamp voltage has not reached the rated range due to the adhesion of a scattered part of the material for the discharge electrode to the tube wall or something (e.g., water) other than the discharge lamp is connected between or in contact with the AC output terminals 24 and 24'.

(e) The short-circuiting of the AC output terminals 24 and 24'.

(f) The overvoltage state or abnormal dropping of the battery voltage.

The above states, if they continue, are likely to adversely affect the protection of the discharge lamp and the circuitry, cause an undesirable effect on human bodies or lead a secondary accident. In the case (a), for example, when the high-voltage trigger pulse generated by the igniter circuit 22 is continuously applied to the AC output terminals 24 and 24', electromagnetic interference on the peripheral devices may occur or an accident by electric shock may be caused. In the case (b), the ignition property of the discharge lamp may be deteriorated to cause flickering. In the case (c), if the discharge lamp is kept lit in this condition, leakage of the gas sealed in the discharge lamp therefrom may be encouraged and the discharge lamp may be destroyed in the worst case. In the case (d), excess power is kept supplied to the discharge lamp, so that the discharge lamp may be broken or the circuit elements may be degraded or damaged. In the case (e), the short-circuit current may cause degrade or damage the circuit elements. In the case (f), the components of the DC power supply circuit 20 may be broken or the like.

Figure 11:
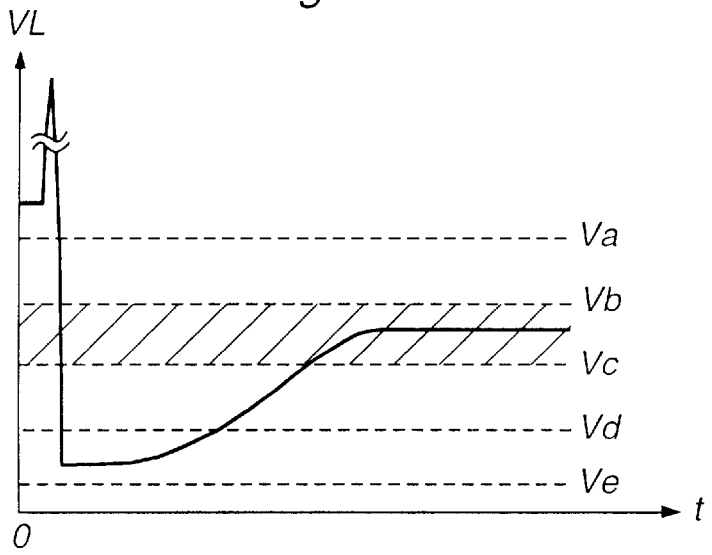
FIG. 11 is a diagram for explaining how a detected voltage associated with a discharge lamp varies with time and how to set reference values for comparison according to this embodiment.

To detect the occurrence of such abnormal states, reference values for comparison associated with the cases (a) to (e) are set as shown in FIG. 11 with respect to the detected voltage VL associated with the discharge lamp in this embodiment.

FIG. 11 exemplifies a time-dependent change in the detected voltage VL associated with the discharge lamp and the setting of reference values for comparison when the discharge lamp is properly lit from the cold state, with the time t taken on the horizontal scale and the detected voltage VL on the vertical scale. Va, Vb, Vc, Vd and Ve ($Va>Vb>Vc>Vd>Ve$) respectively indicate the reference values for the detection of the states (a) to (e).

The detected voltage VL temporarily increases due to the influence of the high-voltage trigger pulse generated by the igniter circuit 22 immediately after lighting of the discharge lamp 23, then sharply drops after the ignition of the discharge lamp 23, and gradually rises up to a value in the range indicated by $Vc \leqq VL \leqq Vb$ (which corresponds to the area C).

Figure 12:
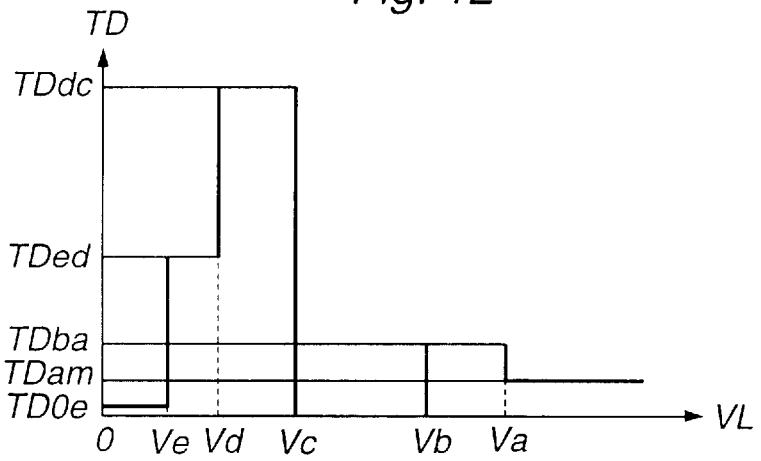
FIG. 12 is a diagram for explaining how to set determination times with respect to the reference values in FIG. 11.

FIG. 12 shows the voltage ranges separated in accordance with the reference values Va to Ve and determination times respectively set for those ranges, with the detected voltage VL taken on the horizontal scale and the determination time TD on the vertical scale.

In this diagram, "TDoe" indicates the determination time when $0 \leqq VL \leqq Ve$, "TDed" indicates the determination time when $Ve \leqq VL \leqq Vd$, "TDdc" indicates the determination time when $Vd \leqq VL < Vc$, "TDba" indicates the determination time when $Vb \leqq VL \leqq Va$, and "TDam" indicates the determination time when $Va \leqq VL$ where $TDoe<TDam<TDba<TDed<TDdc$.

Although the generation of the trigger pulse temporarily cause $VL>Va$ at the time of igniting the discharge lamp 23, the discharge lamp is spontaneously lit and VL sharply drops in the normal state so that the duration of the state of $VL>Va$ is shorter than the determination time TDam. In the case (a), however, the duration of this state becomes longer than TDam so that the occurrence of an abnormality is determined In the case (b), VL varies according to the flickering of the discharge lamp 23 and the occurrence of an abnormality can apparently be determined when the duration of the state $Vb \leqq VL \leqq Va$ in the area above the rated range ($Vc \leqq VL \leqq Vb$) is longer than the determination time TDba. In the case (c), VL varies according to the flickering of the discharge lamp 23 and the occurrence of an abnormality can apparently be determined when the duration of the state $Vd \leqq VL < Vc$ in the area below the rated range is longer than the determination time TDdc.

In the normal lighting of the discharge lamp, VL rises after lighting and the duration of the state of $Ve \leqq VL \leqq Vd$ is shorter than the determination time TDed, whereas in the state (d), the duration of this state becomes longer than TDed by which the occurrence of an abnormality is determined, In the state (e), the occurrence of an abnormality is determined as the duration of the state $VL \leqq Ve$ which should never occur in the normal lighting of the discharge lamp is longer than the determination time TDoe.

With regard to the set values of the determination times, it is preferable that TDoe be as small as possible in consideration of the fact that the state (e) never occurs in the normal lighting state and the degree of the consequence of this state (e g., the destruction of circuit elements or the like due to the overcurrent). The determination times TDed and TDdc should be set in consideration of the fact that VL passes the voltage ranges corresponding to those determination times even in the normal lighting state of the discharge lamp and in such a way as to avoid a problem caused when they are set too short (e.g., if a discharge lamp with a low rated voltage due to a productional variation is in use, lighting which should actually be normal may be determined as abnormal when the discharge lamp is lit with the battery voltage lower than the specified level). As the voltage range associated with TDed is lower than that associated with TDdc, TDed can be set shorter than TDdc.

For TDba and TDam, although the times when VL passes the voltage ranges associated with those determination times in the normal lighting state of the discharge lamp become approximately the same, TDba should preferably be set longer than TDam in consideration of the restrike voltage of the discharge lamp entering the voltage range associated with TDba. It is to be noted that the set value of TDba should include a certain degree of allowance in order not to determine the temporary lighting disabled state of the discharge lamp as an abnormal state, and that TDam should be set in light of the level of the trigger pulse from the viewpoint of the probability of lighting the discharge lamp and preventing an electric-shock oriented accident.

As apparent from the above, if the determination times are set on the basis of the necessity of detecting abnormalities associated with the states (a) to (e), the relation between the voltage ranges which are separated according to a plurality of reference values for comparison or reference ranges and determination times associated with those reference values or reference ranges is set in such a manner that the farther a reference value or reference range in the area above or below the voltage range in the normal lighting state or the rated range is located from the voltage range or the rated range, the shorter the associated determination time is set, as illustrated.

The setting of reference values for comparison associated with the state (f) and the associated determination times will be discussed next.

Figure 13:
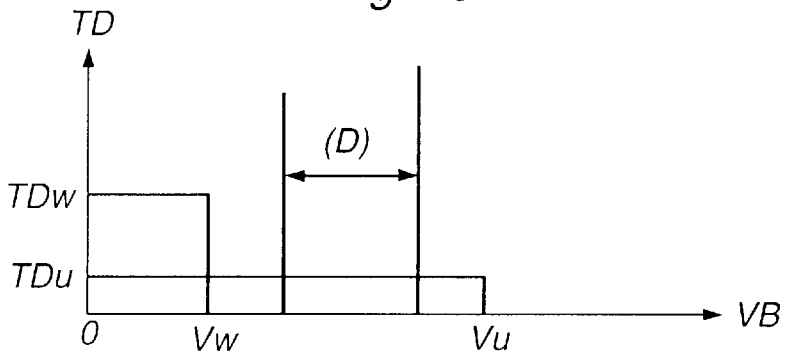
FIG. 13 is a diagram for explaining how to set reference values for comparison associated with a battery voltage and how to set determination times for those reference values.

FIG. 13 exemplifies the setting of a reference value Vu for comparison set above the allowable range of the battery voltage ("VB") indicated by "D" and a reference value Vw for comparison set below the allowable range, and the setting of their associated determination times TDu and TDw, with the battery voltage VB taken on the horizontal scale and the determination time TD on the vertical scale. The determination time TDu is set shorter than the determination time TDw.

While those determination times should be set not to cause the destruction of the lighting circuit or the circuit elements, TDw should be set to such a value as to stop power supply to the discharge lamp before the trigger pulse is supplied to the discharge lamp when mislighting of the discharge lamp has occurred.

In other words, unless the condition "TDw<TT" is given where TT is the generation period of the trigger pulse by the igniter circuit 22, the trigger pulse is generated while the time required to stop the operation of the lighting circuit 15 since the deactivation of the discharge lamp passes, a worker may be exposed to a danger of a high voltage when attending to the damaged lighting circuit or the like, or the discharge lamp may flicker.

As regards the detection of the abnormal drop of the battery voltage VB, regardless of the lighting state of the discharge lamp, an abnormality in the input voltage can be determined not only by simply detecting that the duration of VB dropped to or below the reference value is equal to or greater than TDw but also by detecting the occurrence of mislighting of the discharge lamp when the duration of VB dropped to or below the reference value is equal to or greater than TDw. In the latter case, when the mislighting of the discharge lamp has occurred, the circuit action to try relighting the discharge lamp and the circuit action to stop power supply to the discharge lamp take place simultaneously and thus cause confliction, so that the determination time TDw should preferably be set smaller than the determination time for the detection of the lighting disabled state of the discharge lamp associated with the detection (1) as mentioned above.

Figure 10:
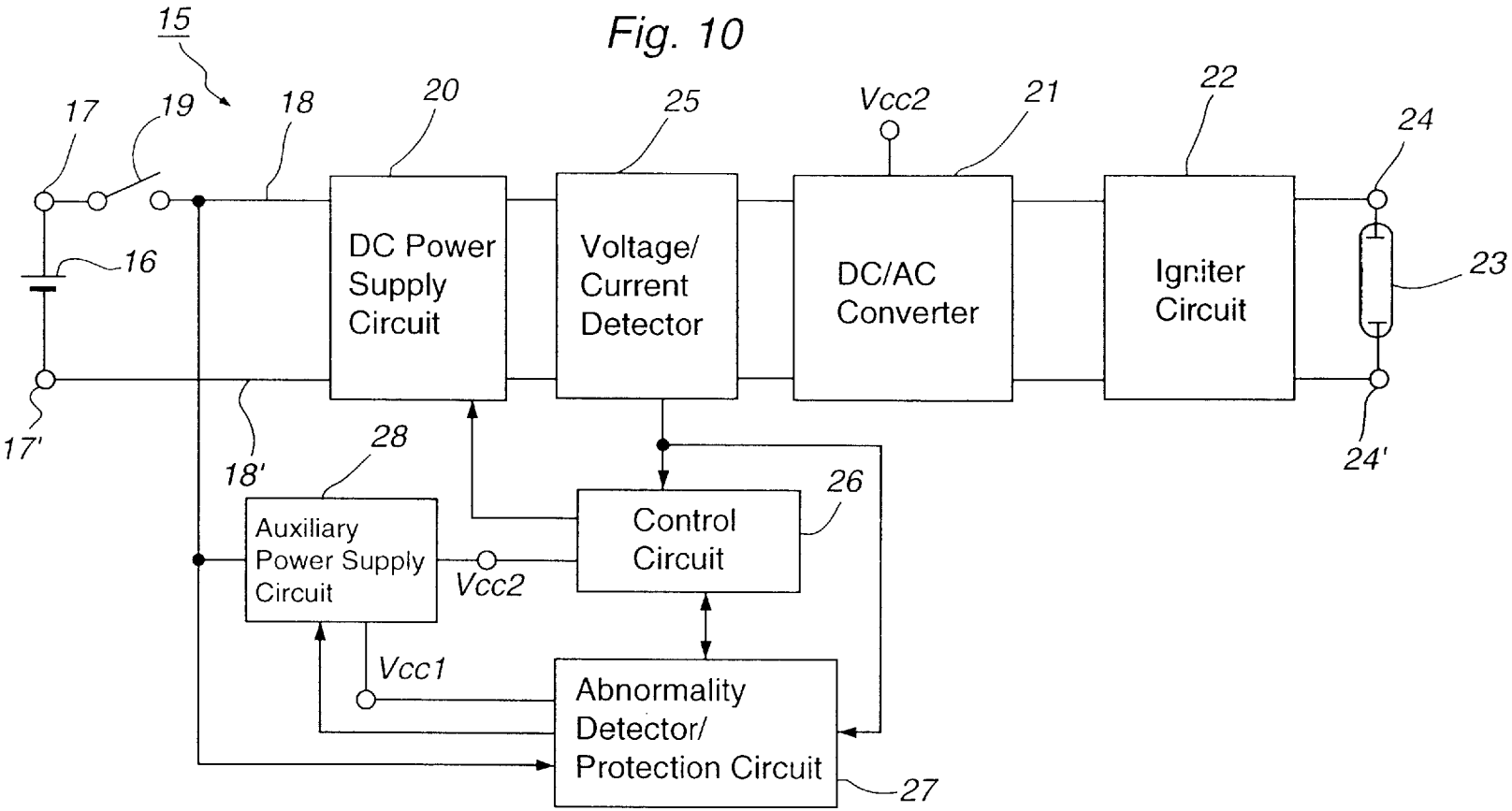
FIG. 10 is a block diagram showing the general circuit structure according to one embodiment of this invention, together with FIGS. 11 to 14.

The abnormality detector/protection circuit 27 detects the occurrence of the above-discussed abnormal states to inhibit power supply to the discharge lamp 23. In this embodiment, as shown in FIG. 10, the abnormality detector/protection circuit 27 prohibits power supply to the discharge lamp 23 by stopping the operation of an auxiliary power supply circuit 28 which supplies the necessary supply voltage to the control circuit 26 and other circuits. The auxiliary power supply circuit 28 is provided as a separate circuit from the power supply path to the discharge lamp 23 and to generate voltages needed by the individual sections of the lighting circuit 15 based on the battery voltage, and receives the battery voltage at the subsequent stage of the ignition switch 19. In FIG. 10, the auxiliary power supply circuit 28 produces voltages "Vcc1" and "Vcc2," the former supplied to the abnormality detector/protection circuit 27 and the latter to the control circuit 26, the DC-AC converter 21, etc. as the supply voltage or a predetermined reference voltage (or its original voltage). Vcc2 becomes zero when an abnormality is detected.

Figure 14:
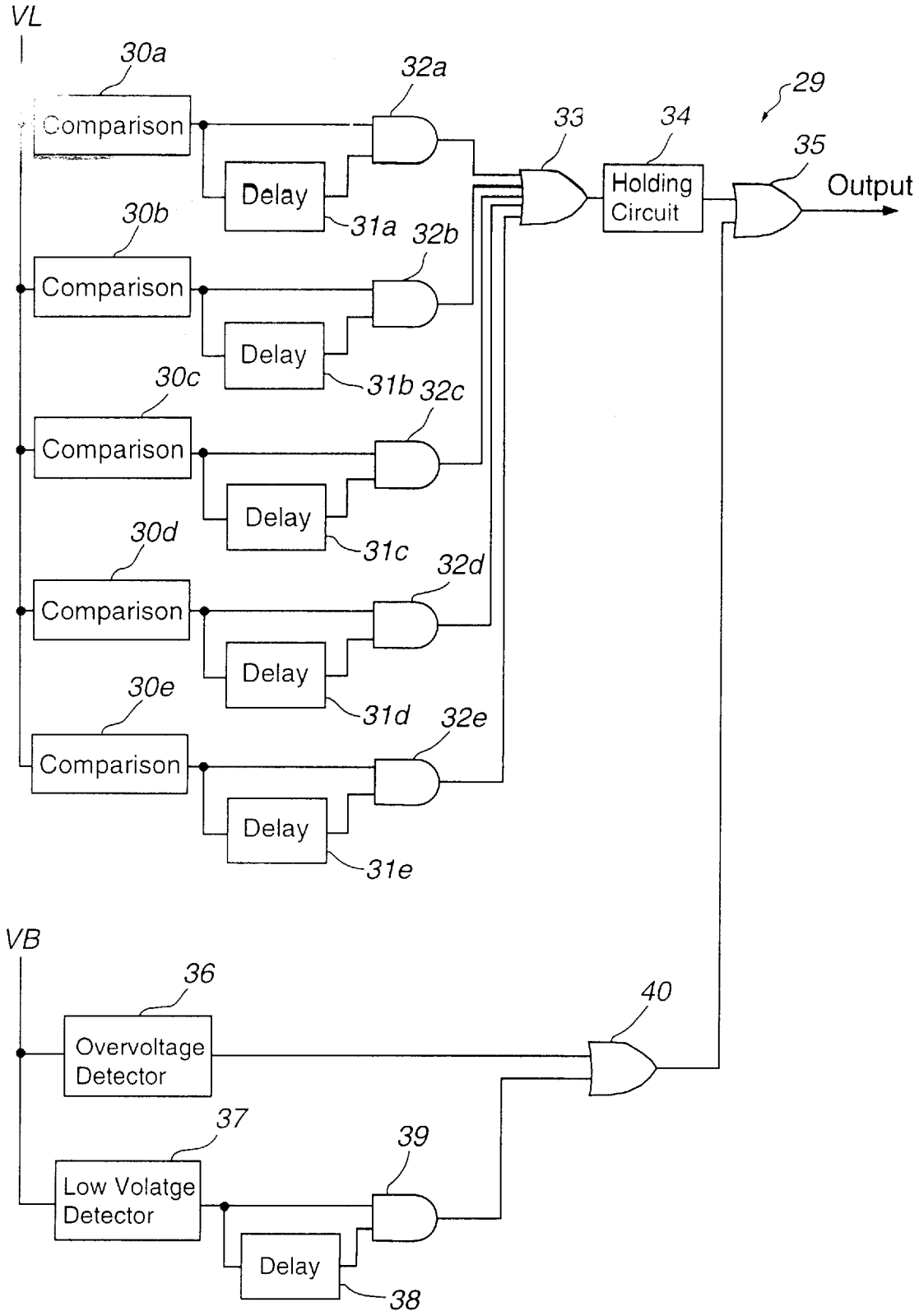
FIG. 14 is a circuit block diagram exemplifying the structure of an abnormality detector/protection circuit according to this embodiment.

FIG. 14 shows a structural example 29 of the essential portions of the abnormality detector/protection circuit 27. The detection section which is associated with the states (a) to (e) comprises comparison circuits 30*a* to 30*e*, delay circuits 31*a* to 31*e*, 2-input AND gates 32*a* to 32*e*, 5-input OR gate 33 and a holding circuit 34.

The comparison circuits 30*a*–30*e*, which correspond to the reference ranges shown in FIG. 12, determine if the detected voltage VL associated with the discharge lamp lies in a predetermined reference range. Specifically, the comparison circuit 30*a* outputs a binary signal reflecting whether or not VL ≧Va, the comparison circuit 30*b* outputs a binary signal reflecting whether or not Vb≦VL<Va, the comparison circuit 30*c* outputs a binary signal reflecting whether or not Vd≦VL<Vc, the comparison circuit 30*d* outputs a binary signal reflecting whether or not Ve≦VL<Vd, and the comparison circuit 30*e* outputs a binary signal reflecting whether or not 0≦VL<Ve.

The output of the comparison circuit 30*a* is split into two, one input to one input terminal of the AND gate 32*a* and the other input via the delay circuit 31*a* to the other input terminal of the AND gate 32*a*. The other comparison circuits 30*b*–30*e* have the same structures as that of the comparison circuit 30*a*. That is, the output of each of the comparison circuits 30*b*–30*e* is split into two, one input to one input terminal of the associated one of the AND gates 32*b*–32*e* and the other input via the associated one of the delay circuits 31*b*–31*e* to the other input terminal of the associated one of the AND gates 32*b*–32*e*. The delay times set in the delay circuits 31*a*–31*e* are respectively equivalent to the aforementioned TDam, TDba, TDdc, TDed and TDoe.

The outputs of the AND gates 32*a*–32*e* are input to the OR gate 33 whose output signal is sent to the holding circuit 34. The output signal of the holding circuit 34 is sent to one input terminal of the 2-input OR gate 35.

The detection section which is associated with the state (f) comprises an overvoltage detector 36, a low voltage detector 37, a delay circuit 38, a 2-input AND gate 39 and a 2-input OR gate 40.

The overvoltage detector 36 outputs an H (High) signal and sends it to one input terminal of the OR gate 40 when the state of the battery voltage VB exceeding the reference value Vu continues for the determination time TDu or longer.

The low voltage detector 37 outputs an H signal and sends it to the AND gate 39 directly or via the delay circuit 38 when the battery voltage VB falls below the reference value Vw. The output signal of the AND gate 39 is sent to the other input terminal of the OR gate 40 whose output signal is input to the other input terminal of the OR gate 35. As already mentioned, the determination time TDw is equivalent to the delay time in the delay circuit 38 and should preferably be set shorter than TDam or TDba.

If the set values of the determination times are relatively long, circuits like the delay circuits 31*a*–31*e* and 38 should be added positively, whereas if the set values of the determination times are short, the delay circuits can be omitted by using the signal delay times originated from the circuit elements, thus simplifying the overall circuit structure. For example, the latter modification may be employed in the overvoltage detector 36.

According to the circuit 29, the comparison circuits 30*a*–30*e* detect in which reference range the level of the detected voltage VL lies, and when the duration of VL lying in this reference range becomes equal to or greater than a predetermined determination time, the output of one of the AND gates 32*a*–32*e* becomes the H signal which is sent to the OR gate 33 and is held by the holding circuit 34. This signal held state continues until the supply voltage is supplied again.

The output of the OR gate 40 goes high when the overvoltage state of the battery voltage VB or the abnormal dropping of the battery voltage VB continues for a predetermined determination time or longer.

When the output signal of the OR gate 35 becomes an H signal in response to the output signals of the holding circuit 34 and the OR gate 40, power supply to the discharge lamp is stopped.

According to the first aspect of this invention, as described above, a plurality of reference values for comparison or a plurailty of reference ranges are set for the detected voltage and/or the detected current associated with a discharge lamp, and determination times are separately set in association with those reference values or reference ranges, whereby comparison and determination can be executed specifically in accordance with the cause for an abnormal state, thus making it possible to reduce the frequency of occurrence of erroneous detection.

According to the second aspect of this invention, the determination times for the reference values or the reference ranges are set long or short in accordance with the degree of deviation of the detected voltage and/or the detected current of the discharge lamp from the allowable range for the steady lighting state of the discharge lamp or the lighting state in the rated range, whereby the detection of abnormalities is weighted.

According to the third aspect of this invention, determination times for the reference values or reference ranges which lie above or below the allowable range which indicates the steady lighting state of the discharge lamp or the rated range thereof are set individually with respect to the associated reference values or reference ranges, thus permitting the determination times to be set in accordance with the cause for an abnormal state.

According to the fourth aspect of this invention, the determination times to be set for the reference values or reference ranges which lie above the allowable range indicating the steady lighting state of the discharge lamp or the rated range thereof, are set shorter than those determination times to be set for the reference values or reference ranges which lie below the allowable range, whereby even when the characteristic of the discharge lamp associated with the steady lighting of the discharge lamp or associated with the time for the voltage and/or the current concerning the discharge lamp to reach the rated range varies, the frequency of occurrence of erroneous detection can be reduced.

According to the fifth aspect of this invention, any determination time for the associated reference value or reference range which is set to or in the vicinity of zero with respect to the detected voltage and/or the detected current associated with the discharge lamp is set shorter than the other determination times, so that a critical abnormality can be coped with promptly.

According to the sixth aspect of this invention, the determination times are set in a stepwise manner with respect to the reference values or reference ranges, reducing the number of determination times to be set and thus facilitating the setting process.

According to the seventh aspect of this invention, a plurality of reference values for comparison or a plurality of reference ranges are set with respect to the input voltage and/or the input current to the lighting circuit, and determination times are individually set in association with those reference values or reference ranges, whereby comparison and determination can be executed in accordance with the excess input voltage and input current or the abnormal dropping thereof, thus making it possible to reduce the frequency of occurrence of erroneous detection.

According to the eighth aspect of this invention, the determination times for the reference values or the reference ranges are set long or short in accordance with the degree of deviation of the input voltage and/or the input current of the discharge lamp from the allowable range to thereby permit the detection of abnormalities to be weighted, whereby the time required for power supply to the discharge lamp to be stopped can be changed in accordance with the fluctuation of the input voltage.

According to the ninth aspect of this invention, determination times to be set for the reference values or reference ranges which lie above and below the allowable range of the input voltage and/or the input current to the lighting circuit are individually set, so that the excess state of the input voltage and the input current can be distinguished from the abnormal dropping thereof and the times for stopping power supply to the discharge lamp in both states can be controlled to be different from each other.

According to the tenth aspect of this invention, the determination times to be set for reference values for comparison or reference ranges with respect to the detection signal associated with the drop of the input voltage to the lighting circuit are set shorter than the determination times to be set for reference values for comparison or reference ranges with respect to the detection signal associated with the detected voltage and/or detected current of the discharge lamp (the detection signal indicating the open state of the connector terminal to the discharge lamp or the lighting disabled state of the discharge lamp), whereby when the discharge lamp temporarily becomes the lighting disabled state due to the dropped input voltage, power supply to the discharge lamp is not stopped immediately and control is performed to assist the relighting of the discharge lamp as much as possible when there is a chance that the discharge lamp will be lit again when the input voltage is returned to the proper range.

According to the eleventh aspect of this invention, the determination times in the input voltage/current detection means or the input-voltage drop detection means are set shorter than the generation interval of the trigger pulse to be supplied to the discharge lamp, so that the trigger pulse to the discharge lamp is prevented from being generated within the period from the detection of an abnormality associated with the input voltage and input current to the inhibition of power supply to the discharge lamp, thus improving the degree of safety and visibility.

What is claimed is:

1. A lighting circuit for a discharge lamp, comprising:

detection means for detecting a voltage and/or a current to be applied to a discharge lamp or a voltage and/or a current equivalent thereto; and abnormality detection means for stopping power supply to said discharge lamp when detecting an abnormality in said discharge lamp or a circuit abnormality based on a detection signal from said detection means, whereby said abnormality detection means has a plurality of reference values for comparison or a plurality of reference ranges to be set for said detection signal from said detection means, and determination times to be respectively set in association with said plurality of reference values or reference ranges, compares a level of said detection signal with each of said reference values or said reference ranges and determines that an abnormality in said discharge lamp or a circuit abnormality has occurred when a certain comparison result continues for an associated determination time or longer.

2. The lighting circuit according to claim 1, wherein said determination times are set in such a manner that the farther said reference values or said reference ranges are set from an allowable range for said level of said detection signal from said detection means, which indicates a steady lighting state of said discharge lamp or a rated range, the shorter said determination times are made.

3. The lighting circuit according to claim 2, wherein any determination time set for associated one of said reference values or reference ranges which is set to or close to zero with respect to said level of said detection signal from said detection means, is set shorter than those determination times which are set for the other reference values or reference ranges.

4. The lighting circuit according to claim 2, wherein said determination times are set in a stepwise manner with respect to said reference values or reference ranges.

5. The lighting circuit according to claim 1, wherein any determination time set for associated one of said reference values or reference ranges which lies above an allowable range for said level of said detection signal from said detection means, differs from any determination time set for associated one of said reference values or reference ranges lying below said allowable range.

6. The lighting circuit according to claim 5, wherein said determination times are set in a stepwise manner with respect to said reference values or reference ranges.

7. The lighting circuit according to claim 5, wherein any determination time set for associated one of said reference values or reference ranges which lies above an allowable range for said level of said detection signal from said detection means, is shorter than any determination time set for associated one of said reference values or reference ranges lying below said allowable range.

8. The lighting circuit according to claim 7, wherein said determination times are set in a stepwise manner with respect to said reference values or reference ranges.

9. The lighting circuit according to claim 1, wherein any determination time set for associated one of said reference values or reference ranges which is set to or close to zero with respect to said level of said detection signal from said detection means, is set shorter than those determination times which are set for the other reference values or reference ranges.

10. The lighting circuit according to claim 1, wherein said determination times are set in a stepwise manner with respect to said reference values or reference ranges.

11. A lighting circuit for a discharge lamp, comprising:

input voltage/current detection means for detecting an input voltage and/or an input current to said lighting circuit; and abnormality detection means for stopping power supply to said discharge lamp when detecting an abnormality in a value of said input voltage based on a detection signal from said input voltage/current detection means, whereby said abnormality detection means has a plurality of reference values for comparison or a plurality of reference ranges to be set for said detection signal from said input voltage/current detection means, and determination times to be respectively set in association with said plurality of reference values or reference ranges, compares a level of said detection signal with each of said reference values or said reference ranges and determines that an abnormality in an input voltage value and/or an input current value has occurred when a certain comparison result continues for an associated determination time or longer.

12. The lighting circuit according to claim 11, wherein said determination times are set in such a manner that the farther said reference values or said reference ranges are set from an allowable range for said level of said detection signal from said input voltage/current detection means, which indicates a steady lighting state of said discharge lamp or a rated range, the shorter said determination times are made.

13. The lighting circuit according to claim 12, wherein said determination times in said input voltage/current detection means are set shorter than a generation interval of a trigger pulse for igniting said discharge lamp.

14. The lighting circuit according to claim 12, wherein any determination time set for associated one of said reference values or reference ranges which lies above a predetermined allowable range associated with said level of said detection signal from said input voltage/current detection means, differs from any determination time set for associated one of said reference values or reference ranges lying below said allowable range.

15. The lighting circuit according to claim 14, wherein said determination times in said input voltage/current detection means are set shorter than a generation interval of a trigger pulse for igniting said discharge lamp.

16. The lighting circuit according to claim 11, wherein any determination time set for associated one of said reference values or reference ranges which lies above a predetermined allowable range associated with said level of said detection signal from said input voltage/current detection means, differs from any determination time set for associated one of said reference values or reference ranges lying below said allowable range.

17. The lighting circuit according to claim 16, wherein said determination times in said input voltage/current detection means are set shorter than a generation interval of a trigger pulse for igniting said discharge lamp.

18. The lighting circuit according to claim 11, wherein said determination times in said input voltage/current detection means are set shorter than a generation interval of a trigger pulse for igniting said discharge lamp.

19. A lighting circuit for a discharge lamp, comprising:

status detection means for detecting an open state of a connector terminal to be connected to a discharge lamp and a lighting disabled state of said discharge lamp by detecting a voltage and/or a current to be applied to a discharge lamp or a voltage and/or a current equivalent thereto;

input-voltage drop detection means for detecting if an input voltage to said lighting circuit is equal to or lower than a predetermined value; and abnormality detection means for stopping power supply to said discharge lamp when detecting an abnormality in said discharge lamp or abnormal connection thereto based on a detection signal from said status detection means, and temporarily stopping power supply to said discharge lamp when detecting an abnormal drop of said input voltage based on said detection signal from said input-voltage drop detection means, whereby determination times to be set for reference values for comparison or reference ranges associated with said detection signal from said input-voltage drop detection means are set shorter than determination times to be set for reference values for comparison or reference ranges associated with a detected voltage and/or a detected current relating to said discharge lamp and output from said status detection means, and said abnormality detection means compares a level of said detection signal, associated with said discharge lamp or said input voltage, with each of associated reference values or reference ranges, and determines that an abnormality in said discharge lamp or an abnormality in connection thereto or an input voltage value has occurred when any one of comparison results continues for an associated determination time or longer.

20. The lighting circuit according to claim 19, wherein said determination times in said input-voltage drop detection means are set shorter than a generation interval of a trigger pulse for igniting said discharge lamp.

* * * * *

UNITED STATES PATENT AND TRADEMARK OFFICE

CERTIFICATE OF CORRECTION

PATENT NO. : 5,828,177

DATED : October 27, 1998

INVENTOR(S): ATSUSHI TODA ET AL.

It is certified that error appears in the above-identified patent and that said Letters Patent is hereby corrected as shown below:

On the title page, item [54]:

"LIGHT" should read --LIGHTING--.

SHEET 8

FIGURE 14, "Volatge" should read --Voltage--.

COLUMN 1

Line 1, "LIGHT" should read --LIGHTING--;
Line 52, "longer It" should read --longer. It--.

COLUMN 3

Line 32, "abnormality" should read --abnormality.--.

COLUMN 5

Line 11, "tying" should read --lying--;
Line 13, "1With" should read --With--;
Line 14, "set," should read --set;--.

UNITED STATES PATENT AND TRADEMARK OFFICE

CERTIFICATE OF CORRECTION

PATENT NO. : 5,828,177

DATED : October 27, 1998

INVENTOR(S): ATSUSHI TODA ET AL.

It is certified that error appears in the above-identified patent and that said Letters Patent is hereby corrected as shown below:

COLUMN 9

Line 13, "lead" should read --lead to--;
Line 56, "$0 \leqq VL \leqq Ve$," should read --$0 \leqq VL < Ve$,--;
Line 57, "$Ve \leqq VL \leqq Vd$," should read --$Ve \leqq VL < Vd$,--;
Line 59, "$Vb \leqq VL \leqq Va$," should read --$Vb \leqq VL < Va$,--.

COLUMN 10

Line 2, "mined In" should read --mined. In--;
Line 5, "$Vb \leqq VL \leqq Va$," should read --$Vb \leqq VL < Va$,--.

Signed and Sealed this

Twenty-seventh Day of July, 1999

*Attest:*

Q. TODD DICKINSON

*Attesting Officer*

*Acting Commissioner of Patents and Trademarks*